United States Patent [19]

Roussin

[11] 4,453,772

[45] Jun. 12, 1984

[54] MODULAR IMPACT RIPPER ASSEMBLY

[75] Inventor: Michael A. Roussin, Peoria, Ill.

[73] Assignee: Caterpillar Tractor Co., Peoria, Ill.

[21] Appl. No.: 444,252

[22] PCT Filed: Sep. 27, 1982

[86] PCT No.: PCT/US82/01345

§ 371 Date: Sep. 27, 1982

§ 102(e) Date: Sep. 27, 1982

[51] Int. Cl.[3] ..... E01C 23/09; A01B 35/00

[52] U.S. Cl. ..... 299/37; 172/40; 37/DIG. 18

[58] Field of Search ..... 299/14, 37; 172/40; 37/DIG. 18

[56] References Cited

U.S. PATENT DOCUMENTS

| | | | |
|---|---|---|---|
| 3,386,517 | 6/1968 | Kelley | 172/40 |
| 3,770,322 | 11/1973 | Cobb et al. | 299/37 |
| 3,857,609 | 12/1974 | Felix | 172/40 |
| 3,897,975 | 8/1975 | Cobb et al. | 299/14 |
| 4,003,603 | 1/1977 | Stemler et al. | 299/37 |
| 4,229,044 | 10/1980 | Cobb et al. | 299/37 |
| 4,229,045 | 10/1980 | Gurries | 299/14 X |

*Primary Examiner*—Ernest R. Purser

*Attorney, Agent, or Firm*—Joseph W. Keen

[57] ABSTRACT

An improved ripper assembly (12) is joined to and drawn by a draft device (10) and includes a mounting structure (14), a ripper element (16), and an impactor apparatus (18). The mounting structure (14) includes an upper flange (20) and a lower flange (22) joined together by a pair of side plates (23). Aligned openings (24,26) in the flanges (20,22) permit attachment thereof to the draft device (10) and allows pivoting about a vertical pivot axis (28) when pins (30,32) are installed. The ripper element (16) is pivotable about a horizontal pivot axis (38) and is secured to the mounting structure (14) by a pivot pin (40). The impact apparatus (18) imparts intermittent blows to the ripper element (16) and is joined to the mounting structure (14) by a single upper support pin (44) and two, aligned lower support pins (46). The upper and lower support pins (44,46) are disposed adjacent the upper and lower flanges (20,22), respectively, while the pivot axis (38) extends through the side plates (23) intermediate the upper and lower flanges (20,22). The relative disposition of the component interconnections of the impact ripper assembly (12) and the independent nature of the connections permit separate removal of the ripper element (16) and/or the impactor apparatus (18).

8 Claims, 4 Drawing Figures

10
11
30
28
20
50
44
18
24
23
48
14
40
38
36
26
54
52
22
32
46
42
56
58
12
43
16
34

MODULAR IMPACT RIPPER ASSEMBLY

DESCRIPTION

TECHNICAL FIELD

This invention relates to ground engaging tools, and, more particularly, to modular design of components which together comprise an impact ripper assembly.

BACKGROUND ART

In one form of conventional earth ripper, a ripper tip is mounted to a shank which is pivotally mounted to a tractor beam by a shank pivot pin. As a result of side loadings acting on the ripper during the ripping operation, the shank pivot pins have worn so that the pins, at times, were lost during the ripping operation, causing shutdown of the tractor and ripper for repair. In U.S. Pat. No. 4,229,044 by Cobb and Livesay an improved ripper-impact imparting mechanism and mounting therefor is shown wherein the reciprocatable ripper is pivotally supported with a portion of the force imparter so as to share a common connection. Such apparatus, while performing admirably, does not easily permit servicing of only one of the ripper or impacting mechanism components. Moreover, the load exerted by the ripper on the shank pivot pin cantilevers the load exerted on the clevis pin and thus subjects it to high loads.

A nonswiveling impactor-ripper assembly is illustrated in U.S. Pat. No. 4,003,603 in which the ripper shank and impact apparatus again share a support so as to make separate disassembly and service thereof difficult. U.S. Pat. No. 3,770,322 by Cobb et al illustrates a nonswiveling impactor-ripper apparatus having multiple pivot points for the ripper element.

DISCLOSURE OF THE INVENTION

The present invention includes a mounting structure which may be joined to a draft device so as to swivel about a vertical axis, a ripper element which is connected about a horizontal axis to the mounting structure, and an impact apparatus which is removably joined to the mounting structure at locations remote from the ripper element-mounting structure connection.

BEST MODE FOR CARRYING OUT THE INVENTION

Figure 1:
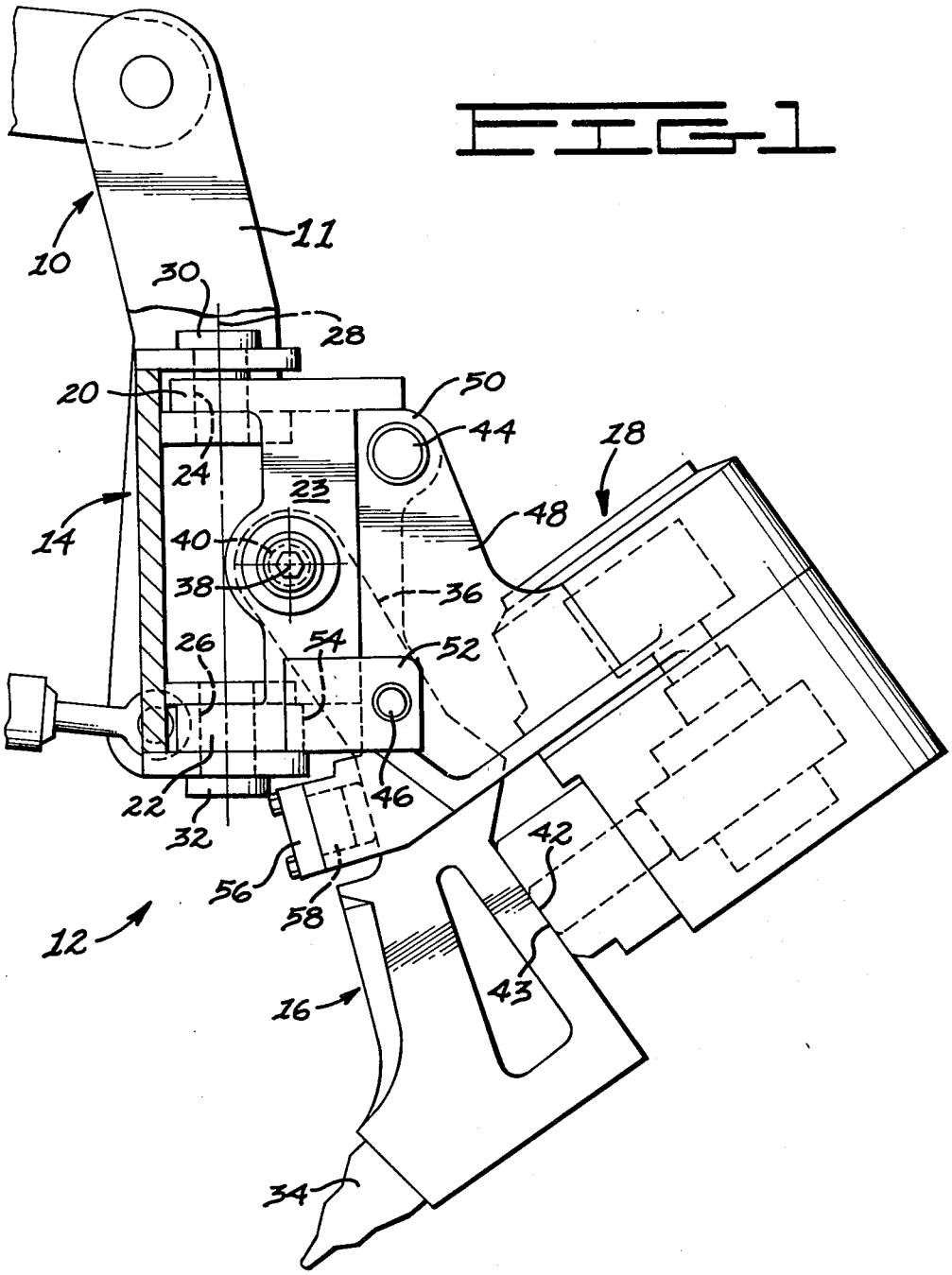
FIG. 1 is a partially cutaway side elevation view of a draft hitch supporting the impact ripper assembly.
Figure 2:
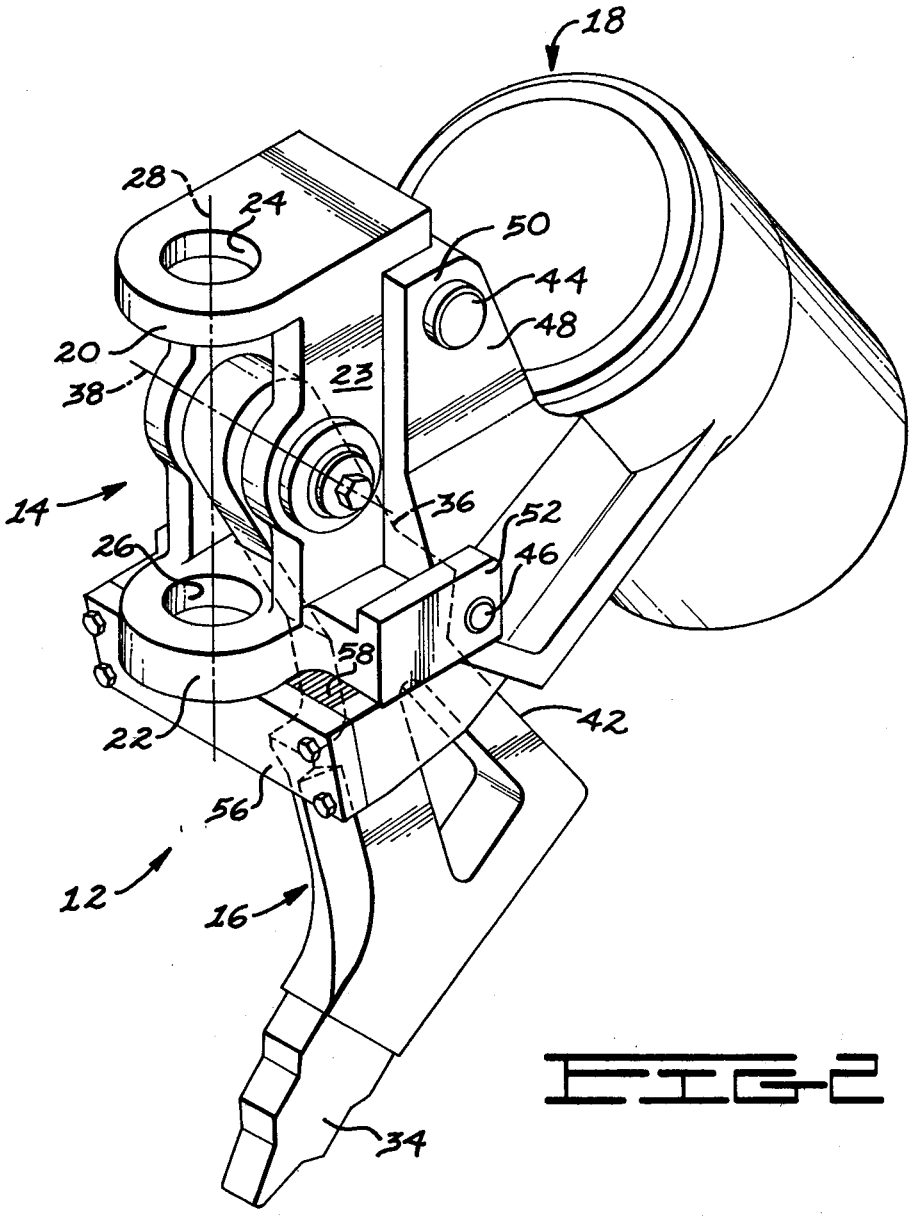
FIG. 2 is an enlarged, isometric view of the ripper assembly illustrated in FIG. 1.

In the illustrated embodiment of the invention as disclosed in FIGS. 1 and 2 an impact ripper assembly 12 is mounted on a draft device or hitch 10 which is attached to and drawn by a tractor for example. The hitch 10 includes a pair of draft arms 11 on the near and far side (the near one has been partially removed for the sake of clarity) of the mounting structure 14 as viewed in FIG. 1. Portions of the hitch 10 are shown in FIG. 1 as partially sectioned and joined to the mounting structure 14 and in FIG. 4 as phantom projections. The ripper assembly 12 includes a mounting structure 14 which is joined to the draft hitch 10, a ripper element 16 which is pivotally mounted on the mounting structure 14, and an impactor apparatus 18 which delivers intermittent blows to the ripper element 16 to facilitate penetration of the earth. To provide perspective for the description which follows the mounting structure 14 and impactor apparatus 18 are respectively disposed near the forward end and the rearward end of the impact ripper assembly 12 as it appears in FIG. 1.

Figure 4:
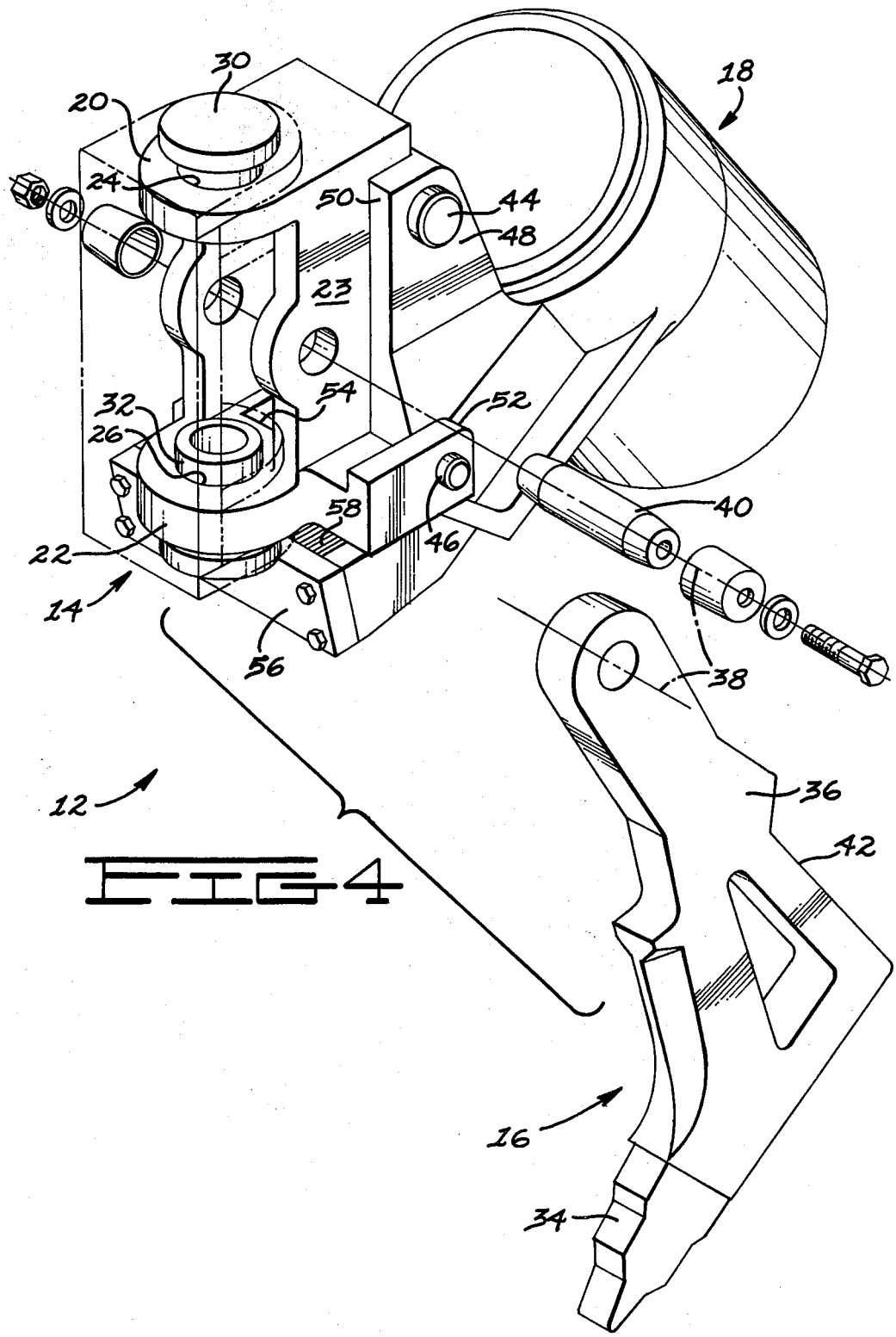
FIG. 4 is a partially exploded view of FIG. 2.

The mounting structure 14 (as best seen in FIG. 4) includes at the forward end thereof an upper flange 20 and a lower flange 22 which are connected by a pair of transversely spaced side plates 23. The flanges 20 and 22 have aligned upper and lower openings 24 and 26, respectively, so as to permit swiveling about a vertical swivel axis 28 when an upper swivel pin 30 and a lower swivel pin 32 are received therein to interconnect the mounting structure 14 and the draft hitch 10.

The ripper element 16 includes a ripper tip 34 which engages the earth and fractures same and a ripper shank 36 which extends upwardly from the ripper tip 34 and is pivotally mounted about a horizontal pivot axis 38 to the mounting structure side plates 23 by a pivot pin 40. The swivel axis 28 is forwardly disposed relative to the pivot axis 40 and the forward most point of the ripper tip 34 is arranged to be directly below the pivot axis 38 when the ripper shank 36 is in its impacting receiving configuration relative to the impactor apparatus 18 as shown in FIG. 1. The pivot pin 40 extends transversely through both side plates 23 and the ripper shank 36 which is sandwiched therebetween.

The ripper shank 36 has an impact surface 42 which is repeatedly struck by an impacting surface 43 which constitutes a portion of the impactor apparatus 18. The impactor apparatus 18 includes a conventional operating motor which drives a flywheel-crankshaft ring impactor which together constitute a conventional rock breaker mechanism. Since such impactor apparatus are well known to those skilled in the art, no further description of the components thereof will be provided herein. The impactor apparatus 18 is supported on the mounting structure 14 by a single upper support pin 44 and two lower support pins 46. The upper support pin 44 extends through a pair of support plates 48 which constitute portions of the impactor apparatus 18 and which sandwich therebetween a pair of upper support ears 50 constituting a portion of the mounting structure 14 while each of the two lower support pins 46 protrudes through the two lower support ears 52 and one of the support plates 48 which is sandwiched therebetween. The upper support ear 50 is preferably disposed adjacent the upper flange 20 while the lower support ears 52 are preferably disposed adjacent the lower flange 22.

The horizontal pivot axis 38 for the ripper element 16 is located intermediate the upper and lower flange 20 and 22, respectively, so as to better distribute the reaction force exerted on the mounting structure 14 by the ripper element 16. A slot 54 is disposed in the lower flange 22. A stop member 56 is joined to the forward end of the impactor support plates 48 to capture the ripper element 16 between the impact supplying surface 43 of the impactor apparatus 18 and the stop member 56. A resilient bumper 58 which is preferably integral with the stop member 56 cushions the forward pivoting movement of the ripper element 16 and prevents engagement between the end of the slot 54 and the ripper shank 36 during operation thereof.

Industrial Applicability

The impact ripper assembly 12 may be utilized as an impact energy source such as is typically mounted at the rear of an earthmoving machine. One form of machine with which the ripper structure may be advantageously utilized is a tractor. During forward movement (to the left of FIG. 1) of the ripper assembly 12, the ripper tip 34 is selectively engageable with the earth. Transverse swiveling of the entire ripper assembly 12 about the swivel axis 28 is permitted up to the preferable limits of 30° each side of the longitudinal center plane. The swivel pins 30 and 32 constitute the only joints in the ripper assembly 12 which are not easily field servicable due primarily to the severe operational loading imposed thereon and thus the high force necessary for their insertion and extraction.

Separating the mounting structure's upper support ears 50 from the lower support ear's 52 by the maximum possible distance consistent with minimizing the size of the mounting structure 14 provides maximum mounting rigidity for the impactor apparatus 18 and thus maximizes the effectiveness of each impact blow. Fabricating the mounting structure 14 in a "box" cross section provides the high structural strength necessary to effectively, independently support the ripper element 16 and impactor apparatus 18. The slot 54 provides the necessary clearance for arcuately reciprocating the ripper element 16 with respect to the mounting structure 14. The previously described relative disposition of the swivel axis 28, pivot axis 38, and ripper tip 34 tends to guide the tip 34 into the material to-be-fractured, prevents tip deflection away from hard points in that material, and increases the effectiveness of the ripper assembly 12.

Figure 3:
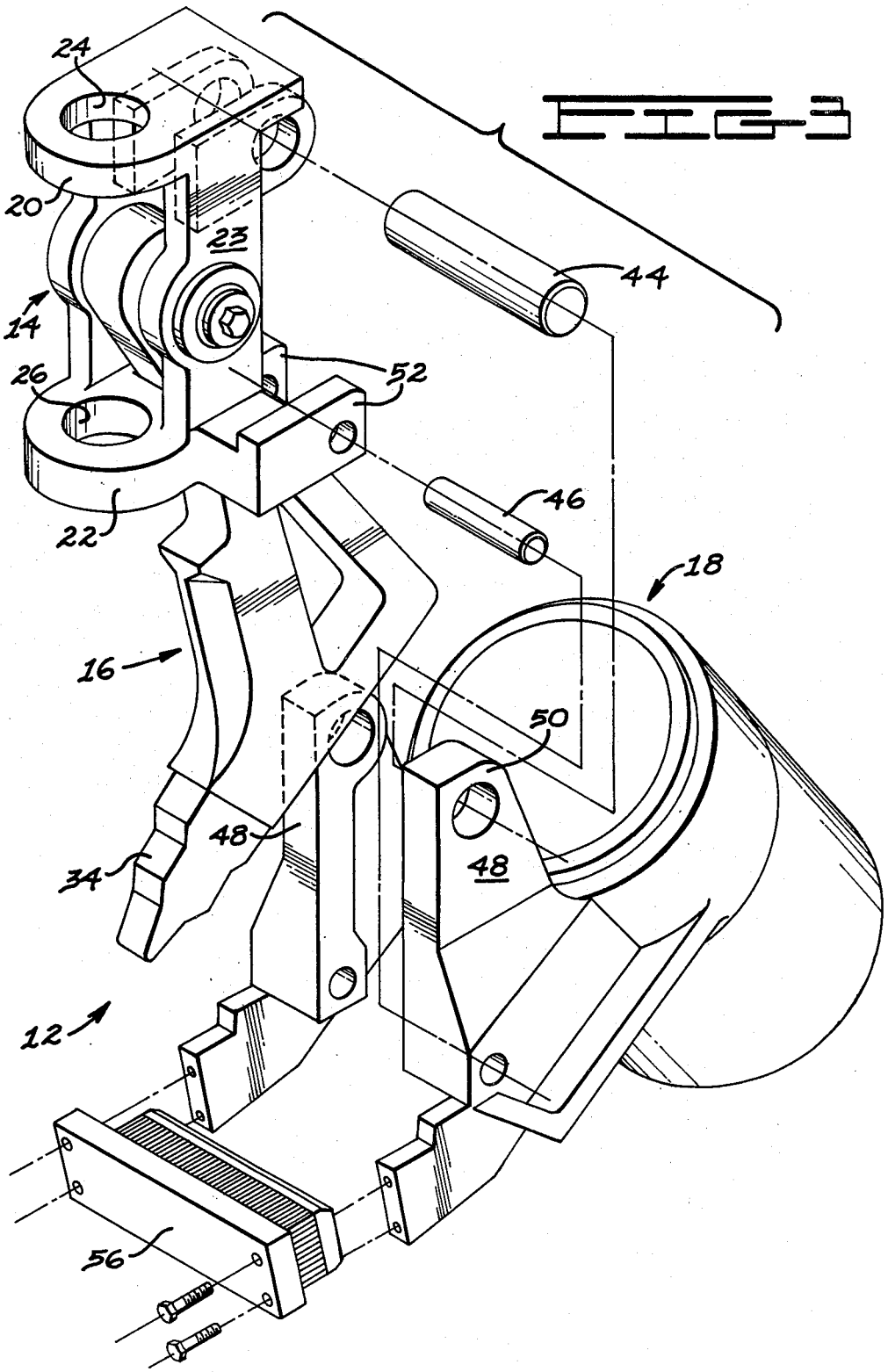
FIG. 3 is a partially exploded view of FIG. 2.

The single upper support pin 44 and the dual lower support pins 46, when removed, permit disassembly of the impactor apparaus 18 from the ripper assembly 12 so as to simplify servicing thereof while removal of the pivot pin 40 likewise permits removal of the ripper element 16. FIGS. 3 and 4 respectively illustrate such removal as well as further disassembly (in FIG. 3) of the stop member 56 and bumper 58 from the impactor apparatus 18. The independent connection of the impactor apparatus 18 with the mounting structure 14 and the ripper element 16 with the mounting structure 14 facilitates servicing and/or replacement of those parts without disturbing the remaining components of the ripper assembly 12.

It should now be apparent that an improved ripper assembly 12 has been provided in which the ripper element 16 and the impactor apparatus 18 are separately and independently supported on a rigid mounting structure 14. The connection between the mounting structure 14 and the impactor apparatus 18 is optimally arranged to provide maximum rigidity in the minimum space possible while the ripper element 16 is connected to the mounting structure 14 about an axis 38 which is advantageously located to uniformly distribute forces imposed upon the mounting structure 14 by the ripper element 16.

I claim:

1. An impact ripper assembly (12) comprising:

a mounting structure (14) pivotally connectable at a forward end thereof about a vertical swivel axis (28) to a draft device (10), said mounting structure including an upper (20) and a lower (22) flange each of which has an opening (24,26) therein, said openings (24,26) being aligned along said vertical swivel axis (28) and a pair of transversely separated side plates (23) joined to said upper (20) and lower (22) flanges;

a ripper element (16) removably pivotably connectable about a horizontal pivot axis (38) to said mounting structure (14) and having an impact surface (42); and an impactor apparatus (18) which is removably connectable to said mounting structure (14) independent of said ripper element (16), said impactor apparatus (18) being disposed at the rearward end of said mounting structure (14) and having an impacting surface (43) for engaging said impact surface (42).

2. The impact ripper assembly (12) of claim 1 wherein said ripper element (16) is pivotally connectable to said side plates (23) intermediate said upper (20) and lower (22) flanges.

3. The impact ripper assembly (12) of claim 1 wherein said impactor apparatus (18) is attachable to said mounting structure (14) adjacent said upper (20) and lower (22) flanges.

4. The impact ripper assembly (12) of claim 1 wherein said lower flange (22) has a slot (54) therein for receiving said ripper element (16) and for accommodating movement thereof.

5. The impact ripper assembly (12) of claim 1 wherein said side plates (23) extend forwardly on opposite transverse sides of said ripper element (16), said impact apparatus (18) further comprising:

a stop member (56) attachable to said side plates (48) for capturing said ripper element (16) between said stop member (56) and said impacting surface (43).

6. The impact ripper assembly (12) of claim 5 further comprising:

a bumper (58) for resiliently engaging said ripper element (16), said bumper being attachable to said stop member (56).

7. The impact ripper assembly (12) of claim 1 wherein said swivel axis (28) is disposed forwardly of said pivot axis (38).

8. The impact ripper assembly (12) of claim 7 wherein said ripper element (16) includes a tip (34) whose forward most point is disposed at the same forward location and below said pivot axis (38) when said impact surface (42) and said impacting surface (43) are engaged.

* * * * *